United States Patent [19]

Himeji et al.

[11] Patent Number: 4,915,370

[45] Date of Patent: Apr. 10, 1990

[54] PAPER FEEDING DEVICE

[75] Inventors: Tooru Himeji, Sakai; Kiyotaka Arai, Osaka; Masahiro Murakami, Shijonawate, all of Japan

[73] Assignee: Mita Industrial Co., Ltd., Osaka, Japan

[21] Appl. No.: 158,239

[22] Filed: Feb. 19, 1988

[30] Foreign Application Priority Data

Mar. 2, 1987 [JP] Japan ..... 62-30159[U]
Mar. 3, 1987 [JP] Japan ..... 62-30686[U]

[51] Int. Cl.[4] ..... B65H 1/00
[52] U.S. Cl. ..... 271/162; 271/145
[58] Field of Search ..... 271/162, 164, 126, 127, 271/117, 145; 312/330 R, 345, 346, 349

[56] References Cited

U.S. PATENT DOCUMENTS

| | | | |
|---|---|---|---|
| 3,977,666 | 8/1976 | Suzuki et al. | 271/164 |
| 4,219,192 | 8/1980 | Burke | 271/164 |
| 4,422,631 | 12/1983 | Sugizaki | 271/164 |
| 4,610,445 | 9/1986 | Schneider et al. | 271/164 |
| 4,740,817 | 4/1988 | Suzuki et al. | 271/164 |

*Primary Examiner*—Joseph J. Rolla
*Assistant Examiner*—Steve Reiss
*Attorney, Agent, or Firm*—Wenderoth, Lind & Ponack

[57] ABSTRACT

A paper feeding device includes a cassette-receiving section defined in a housing of an apparatus to which the paper feeding device is applied, and a cassette adapted to be detachably loaded into the cassette-receiving section. According to a first aspect, at least one of the cassette or the housing has an inclined portion for conducting the cassette to a cassette-loading opening along a table. According to a second aspect, the under surface of the cassette-receiving section is defined by a first guiding portion extending from the lower edge of the opening for loading, an inclined guiding portion extending in an upwardly inclined manner from the first guiding portion and a second guiding portion extending from the inclined guiding portion. According to a third aspect, the cassette-receiving section has provided therein a first guiding portion extending from the lower edge of the opening for loading, a second guiding portion disposed above the first guiding portion and an inclined guiding portion for conducting projecting guide portions provided on opposite side walls of the cassette to the second guiding portion.

7 Claims, 9 Drawing Sheets

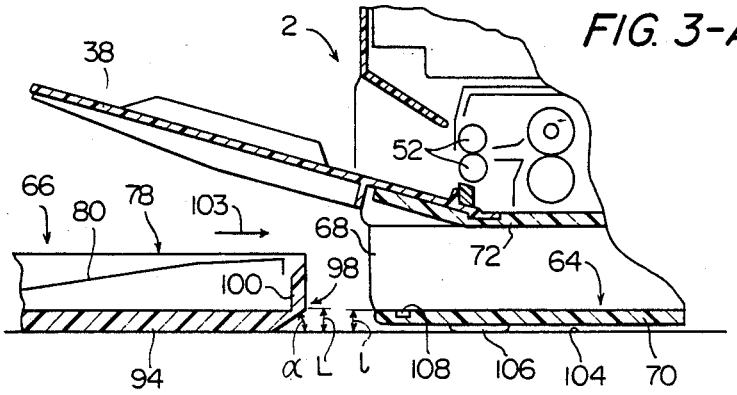
FIG. 3-A
2
38
52
66
80
78
103
68
72
64
100
98
94
α
L
l
108
106
104
70
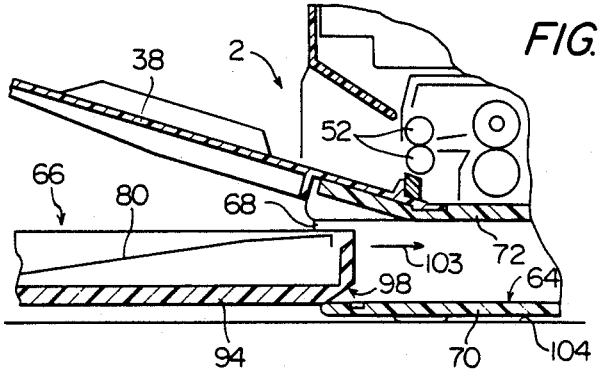
FIG. 3-B
38
2
52
66
80
68
72
103
64
98
94
70
104
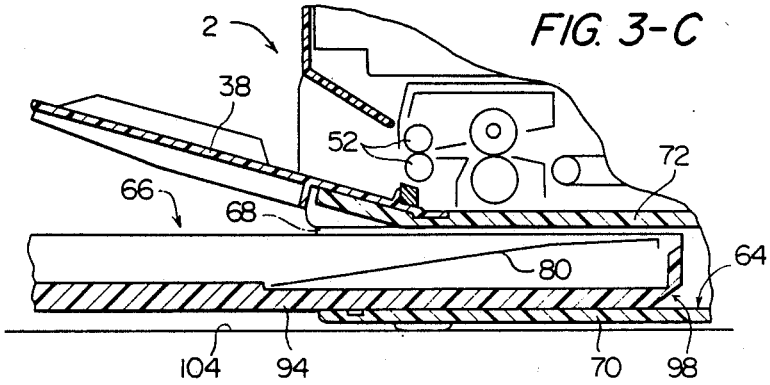
FIG. 3-C
2
38
52
72
66
68
64
80
104
94
70
98

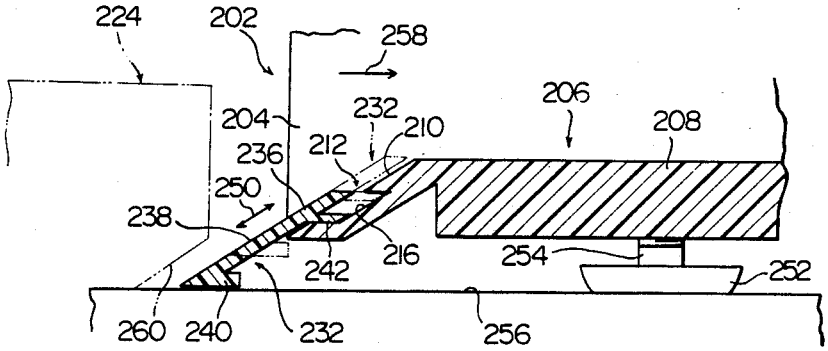
FIG. 5
FIG. 6
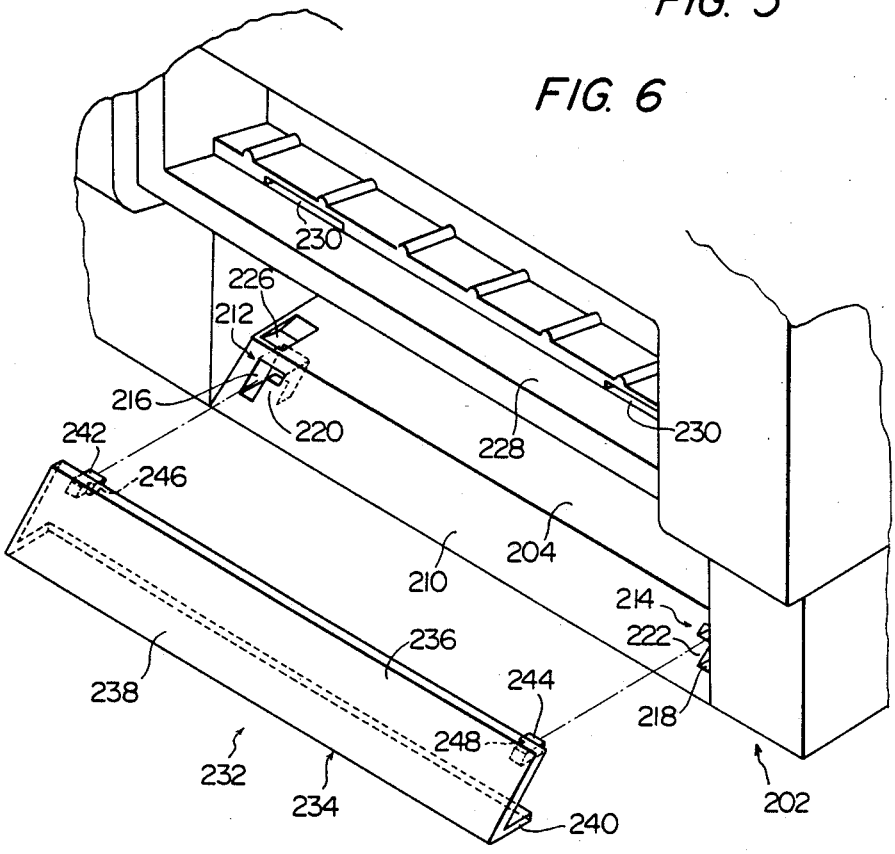

FIG. 11-A
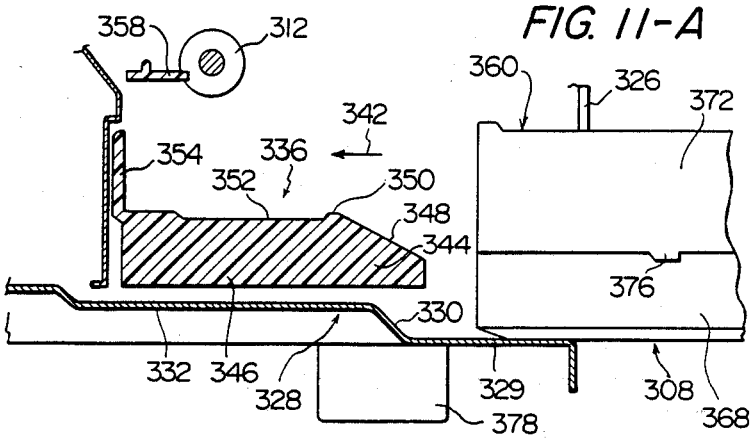
FIG. 11-B
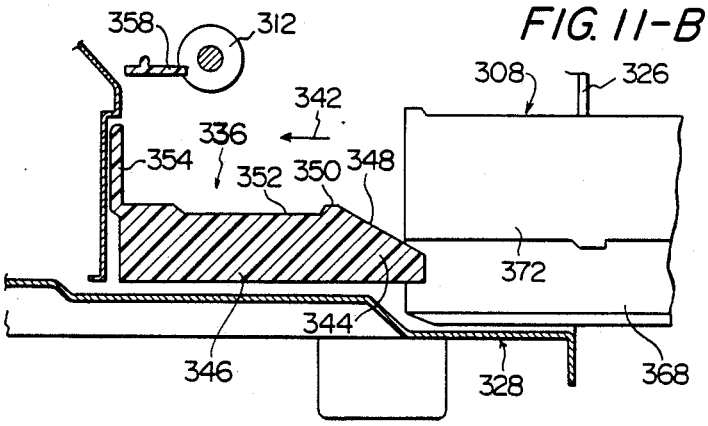
FIG. 11-C
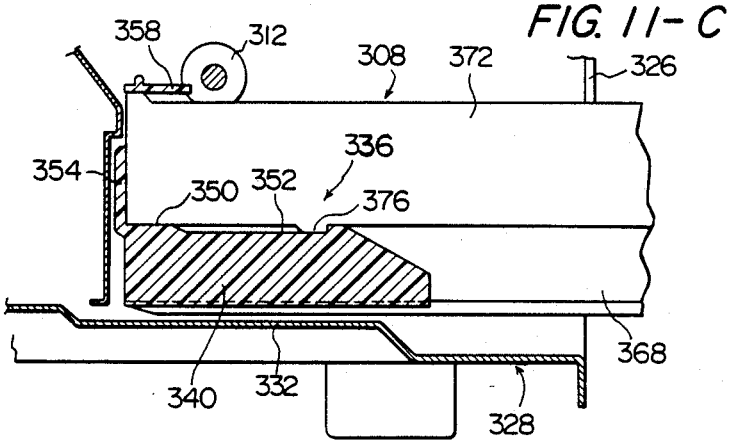

PAPER FEEDING DEVICE

FIELD OF THE INVENTION

This invention relates to a paper feeding device, and more specifically, to a paper feeding device equipped with cassettes adapted to be detachably loaded.

DESCRIPTION OF THE PRIOR ART

Generally, an image-forming machine such as an electrostatic copying machine or an electrostatic printing machine is equipped with a paper feeding device for feeding one-by-one sheet materials such as copying or recording paper sheets. A typical paper feeding device in widespread commercial acceptance comprises a cassette-receiving section defined within a housing of the image-forming machine and a cassette adapted to be detachably loaded into the cassette-receiving section.

However, the conventional paper feeding device has the following problems to be solved.

It is not easy to load the cassette into the cassette-receiving section because a cassette-loading opening (particularly, its vertical dimension) for introducing the cassette therethrough into the housing is relatively small. In particular, a cassette for storing a large number of sheet materials has a considerably large weight. In a type in which the opening for loading is located sideways with respect to the operating position, the operator cannot easily view the opening at the time of loading the cassette, and loading of the cassette thus is difficult. In a type in which the cassette is adapted to be loaded detachably below a receiving tray for receiving sheet materials discharged from the housing, the receiving tray makes it more difficult to view the opening for loading defined in the housing. In a type in which a plurality of cassettes are detachably loaded in stages, a cassette loaded into an upper stage makes it more difficult to view a lower opening for loading a lower cassette, and the loading of the cassettes becomes more troublesome.

SUMMARY OF THE INVENTION

A primary object of this invention is to provide a paper feeding device in which a cassette can be easily loaded into a cassette-receiving section through a opening defined in a housing.

Another object of this invention is to provide a paper feeding device which can be conveniently applied to a small-sized image-forming machine.

Still another object of this invention is to provide a paper feeding device which can be conveniently applied to an image-forming machine of the type in which a plurality of cassettes are loaded in stages.

BRIEF DESCRIPTION OF THE DRAWINGS

FIGS. 3-A to 3-C are partial sectional views illustrating the actions of loading a cassette into a cassette-receiving section in the electrostatic copying machine of FIG. 1.

FIG. 5 is a simplified sectional view showing, on an enlarged scale, part of an electrostatic copying machine equipped with a second embodiment of the paper feeding device in accordance with this invention.

FIG. 6 is an enlarged perspective view showing, in an exploded manner, an opening for cassette loading defined in a housing of the electrostatic machine of FIG. 5 and the vicinity of the opening.

FIGS. 11-A to 11-C are partial sectional views showing the actions of loading a cassette into the cassette-receiving section in the third embodiment.

DETAILED DESCRIPTION OF PREFERRED EMBODIMENTS

The invention will be described further in detail with reference to the accompanying drawings.

Figure 1:
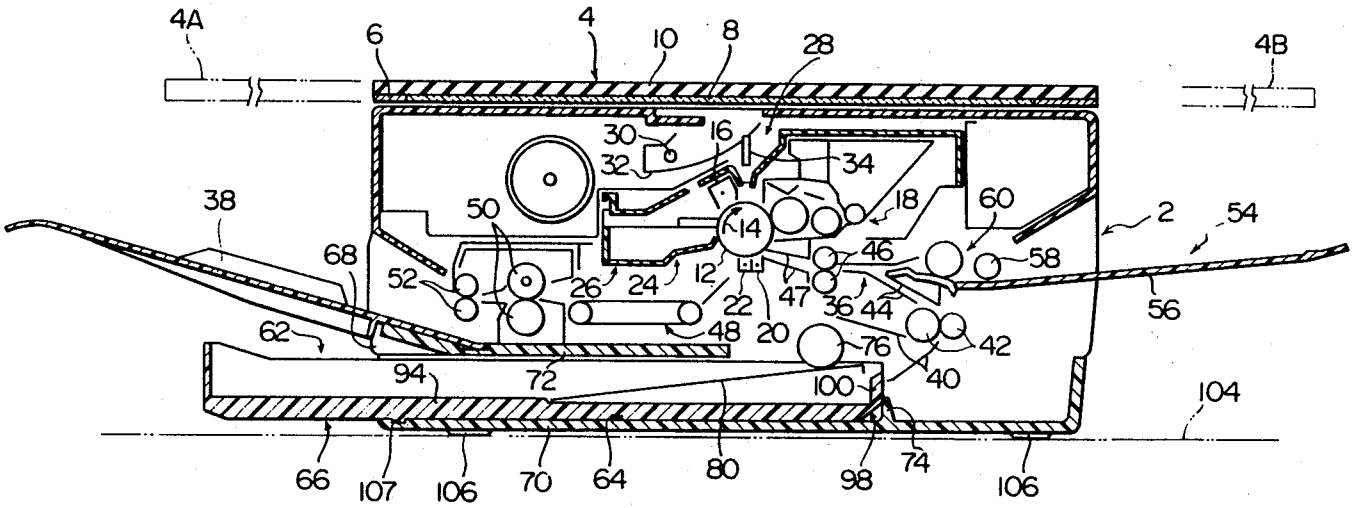
FIG. 1 is a sectional view showing in a simplified manner an electrostatic copying machine equipped with a first embodiment of the feeding device in accordance with this invention.
Figure 2:
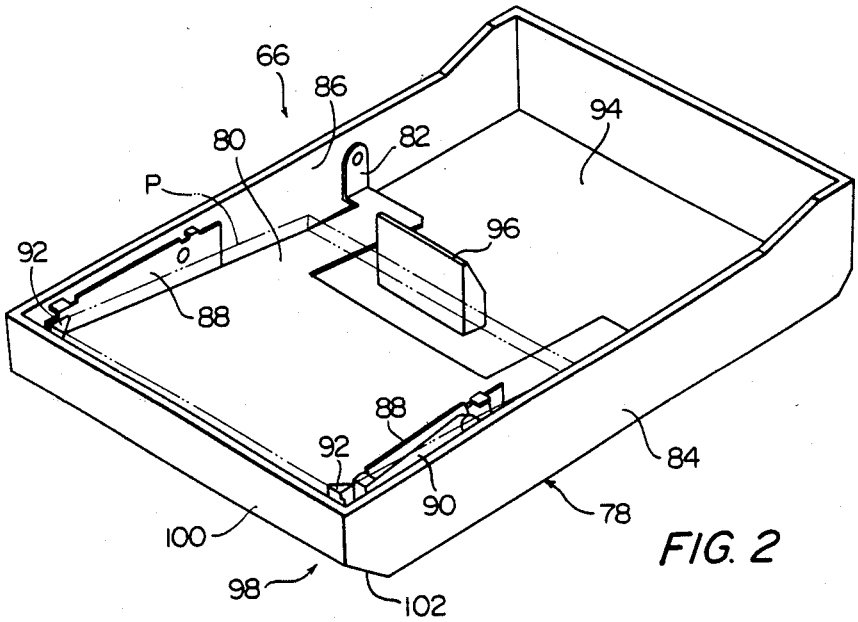
FIG. 2 is a perspective view showing a cassette in the paper feeding device of FIG. 1.

FIGS. 1 to 3 show an electrostatic copying apparatus equipped with a first embodiment of the paper feeding device constructed in accordance with this invention.

Outline of the Electrostatic Copying Machine

With reference FIG. 1, the outline of the electrostatic copying machine will be described. The illustrated electrostatic copying machine is provided with a nearly rectangular parallelpipedal housing 2. A document placing stand 4 is reciprocatingly provided on the upper surface of the housing 2. The document placing stand 4 has a supporting frame 6, a transparent plate 8 fixed to the supporting frame 6 and a cover member 10 for covering a document placed on it for copying. The document placing stand 4 is mounted such that it can freely reciprocate between a start-of-scan position shown by two-dot chain lines 4A in FIG. 1 and a scanning movement limit position shown by two-dot chain lines 4B in FIG. 1.

A rotating drum 12 having a photosensitive material on its peripheral surface is rotatably disposed nearly centrally in the housing 2. Around the rotating drum 12 to be rotated in the direction shown by an arrow 14 are disposed a charging corona discharger 16, a developing device 18, a transfer corona discharger 20, a peeling corona discharger 22 and a cleaning device 24 in this order as viewed in the rotating direction of the drum 12.

The rotating drum 12, the charging corona discharger 16, the developing device 18 and the cleaning device 24 are mounted on a unit frame 26 adapted to be detachably mounted within the housing 2.

In the upper part of the inside of the housing 2 is disposed an optical system 28 provided with an illuminating lamp 30, a reflecting mirror 32 and an optical element 34 comprised of a plurality of rod-like lenses. The illuminating lamp 30 illuminates a document placed on the transparent plate 8 and the reflected light from the document passes through the optical element 34 and is projected onto the photosensitive material in an exposure zone (a zone located between the charging corona discharger 16 and the developing device 18).

A copying paper conveying mechanism shown generally at 36 is disposed in the lower part of the inside of the housing 2. A first embodiment of the paper feeding device in accordance with this invention is provided at one end of the conveying mechanism 36, namely the bottom portion of the inside of the housing 2 in the illustrated embodiment, and a paper receiving tray 38 is disposed at its other end. The paper feeding device will be described hereinafter. A copying paper sheet, which may be ordinary paper, fed from the paper feeding device is conveyed to a space between the rotating drum 12 and the transfer corona discharger 20 and the peeling corona discharger 22 by the action of a pair of guiding plates 40, a pair of feeding rollers 42, a pair of guiding plates 44, a pair of feeding rollers 46 and a pair of guiding plates 47. Then, by the action of a conveyor belt mechanism 48, it is conveyed to a pair of fixing rollers 50, and then by the action of a pair of discharging rollers 52, is discharged out of the housing 2 and received in the receiving tray 38. The upstream end portion of a conveyor passage defined by the various constituent elements described above is branched. One branched end portion extends to the right in FIG. 1, and a manual feeding mechanism 54 is annexed to its one end. The manual feeding mechanism 54 is provided with a table 56, a feed roller 58 disposed above the end of the table 56, and a separating roller mechanism 60.

In the electrostatic copying machine described above, while the rotating drum 12 is rotated in the direction of arrow 14, the charging corona discharger 16 substantially uniformly charges the photosensitive material to a specified polarity. Then, an image of the document is projected onto the photosensitive material through the optical system 28 to form an electrostatic latent image corresponding to the document on the photosensitive material. The developing device 18 then applies toner particles to the electrostatic latent image on the photosensitive material to develop it to a toner image. Copying paper fed from the paper feeding device (or the feeding mechanism 54) is brought into contact with the photosensitive material, and by the action of the transfer corona discharger 20, the toner image on the photosensitive material is transferred to the copying paper. The copying paper is peeled off from the photosensitive material by the action of the peeling corona discharger 22. The copying paper so separated is conveyed between the pair of fixing rollers 50, and during this conveyance, the toner image is fixed to the copying paper. The copying paper having the toner image thus fixed is discharged onto the receiving tray 38. In the meantime, the rotating drum 12 continues to rotate, and by the action of the cleaning device 24, the toner particles remaining on the photosensitive material are removed.

The electrostatic copying device described above is only one example to which the paper feeding device of this invention can be applied. Accordingly, its detailed structure and operation are omitted herein.

First Embodiment of the Paper Feeding Device

The paper feeding device will be described with reference to FIGS. 2 and 3-A in conjunction with FIG. 1. The illustrated paper feeding device 62 is provided with a cassette-receiving section 64 defined at the bottom part of the inside of the housing 2 and a cassette 66 adapted to be detachably loaded into the cassette-receiving section 64. An elongate rectangular cassette-loading opening 68 is defined in the bottom part of the left surface (in FIG. 1) of the housing 2, and the cassette-receiving section 64 extends substantially horizontally to the right from the opening 68. The cassette-receiving section 64 is defined by a bottom wall 70 of the housing 2 which extends horizontally from the lower edge of the opening 68, a partitioning wall 72 extending nearly horizontally from the upper edge of the opening 68 and a projecting wall 74 extending upwardly from the bottom wall 70, and a feed roller 76 is disposed thereabove. No partitioning wall exists at a site corresponding to the site of the feed roller 76.

With reference mainly to FIG. 2, the illustrated cassette 66 is provided with a box-like cassette body 78 having an open top surface, and a placing plate 80 is disposed at the front part of the cassette body 78. A pair of upwardly extending projecting portions 82 (only one of which is shown in FIG. 2) are provided in the rear end portion of the placing plate 80. These projecting portions 82 are pivotally linked to the inside surfaces of side walls 84 and 86 of the cassette body 78 via pins. A pair of supporting plates 88 spaced from each other in the width direction (the direction perpendicular to the sheet surface in FIG. 1, and in the direction from right bottom to left top in FIG. 2) are disposed in the two side parts of the front portion of the cassette body 78. An oscillating member 90 is mounted on each supporting plate 88 oscillate slightly in the vertical direction. A claw member 92 is provided integrally at the front end portion of each oscillating member 90, and the claw member 92 act on corners of the front end part of the copying paper placed on the placing plate 80 at the front end corner portions of the cassette body 78. A rear end regulating member 96 is disposed nearly centrally on the bottom wall 94 of the cassette body 78. A stack of copying paper sheets P is filled in the cassette body 78 as shown by one-dot chain lines in FIG. 2. The stack of copying paper sheets P is placed on the placing plate 80 and the leading ends of the sheets P are regulated by the pair of claw members 92 and their trailing ends by the rear end regulating members 96. The two side edges of the paper sheets are guided by the pair of supporting plates 88. Elastic biasing means (not shown) such as a coil spring is interposed between the bottom wall 94 and the placing plate 80 in the cassette body 78.

The cassette 66 is detachably loaded into the cassette-receiving section 64 through the cassette-loading opening 68 defined in the housing 2 of the electrostatic copying machine. In the illustrated embodiment, the opening 68 is disposed below the fixing site of the receiving tray 38 in the housing 2. Hence, the receiving tray 38 covers the space above the opening 68, and the operator cannot easily see the opening 68 and load the cassette 66.

Thus, the first embodiment of the invention further has the following structure to make it very easy to load the cassette 66. In FIGS. 2 and 3-A, an inclined portion 98 for conducting the cassette 66 to the opening 68 of the housing 2 is provided at the lower end of the front end portion of the cassette body 78. The inclined portion 98 is located in a portion connecting the bottom wall 94 to the front wall 100 in the cassette body 78 and defines an inclined guide surface 102 which is inclined in a straight line upwardly in the loading direction of the cassette 66 shown by an arrow 103 (FIG. 3-A). The inclined guide surface 102 is provided substantially over the entire width of the cassette body 78, and as shown in FIG. 3-A, the height L from its lower end to the upper end is preferably prescribed such that it is substantially equal to, or larger than, the height l from a surface e.g. 104 of a table, on which is placed the housing 2 to the lower edge of the opening 68. This permits the cassette 66 to be conducted accurately to the opening 68. When as in the illustrated embodiment, the inclined guide surface 102 extends in a straight line from its lower end to its upper end, the inclination angle $\alpha$ (the angle of inclination from the surface 104) is preferably set at 1 to 45 degrees. As a result, as the cassette 66 moves in the direction shown by an arrow 103, it can be easily elevated toward the opening 68. The inclined guide surface 102 need not extend in a straight line from one end to the other, and may change in shape halfways. For example, it may have an obtuse shape in which the inclination angle changes once, or an arcuate shape in which the inclination angle continuously changes. In the illustrated electrostatic copying machine, leg portions 106 (only two of them are shown in FIG. 1) are provided at four corner portions of the bottom wall 70 of the housing 2, and can be adjusted in height in the vertical direction (for example, all leg portions 106 may be rendered height-adjustable, or any two or three of the four leg portions 106 may be rendered height-adjustable). In this regard, it is preferred to prescribe the height L of the inclined guide surface 102 such that it is substantially equal to, or greater than, the height from the surface 104 to the lower edge of the opening 68 even in a state where the leg portions 106 are the most elevated.

Now, with reference to FIGS. 3-A to 3-C, the operation of loading and detaching the cassette 66 into and from the paper feeding device 62 will be described.

To load the cassette 66 having copying paper sheets filled therein, the cassette is positioned on the surface 104 of a table on which the housing 2 is placed, as shown in FIG. 3-A. The cassette 66 is then moved in the loading direction shown by arrow 103. As a result, as can be seen from FIGS. 3-A to 3-B, the inclined guide surface 102 provided on the cassette 66 abuts with the left end (in FIGS. 1, 3-A and 3-B) of the bottom wall 70 of the housing 2, and by the action of the inclined guide surface 102, the cassette 66 itself is lifted during its movement in the direction of arrow 103 and thus is conducted to the opening 68 defined in the housing 2 of the electrostatic copying machine.

When the cassette 66 is further moved in the direction shown by arrow 103, the front end portion of the bottom wall 94 of the cassette 66 is positioned at the bottom wall 70 through the opening 68 as shown in FIG. 3-B, and the front end portion of the cassette 66 is introduced into the cassette-receiving section 64. Thereafter, as shown in FIG. 3-C, the cassette is moved further in the direction of arrow 103, and when the front wall 100 of the cassette 66 abuts with the projecting wall 74, the cassette is detachably loaded into the cassette-receiving section 64 (FIG. 1). In this loaded state, the copying paper sheets placed on the placing plate 80 are pressed against the feed roller 76 by the action of the elastic biasing means. Consequently, the feed roller 76 rotates and feeds the paper sheets one by one from the cassette 66.

Unloading the cassette 66 from the cassette-receiving section 64 may be achieved by moving the cassette 66 in the detaching or unloading direction opposite to the direction of arrow 103. The cassette 66 detached by this movement is positioned on the surface 104 of the table on which the housing 2 is placed.

Preferably, the cassette 66 is locked releasably at the loaded position shown in FIG. 1. For this purpose, a projection 107 is provided in the under surface of the bottom wall 94 of the cassette 66 in this embodiment, and at the same time, a depression 108 (FIG. 3-A) for detachably receiving the projection 107 is provided on the upper surface of the bottom wall 70 of the housing 2. The engagement between the projection 107 and the depression 108 can be cancelled by lifting the cassette 66 slightly.

In the first embodiment described above, the cassette 66 can be loaded by positioning it on the surface 104 of the table, for example, on which the housing 2 is placed, and moving it in the loading direction. Detachment of the cassette 66 may be achieved by moving the cassette 66 in the detaching direction. It is not necessary therefore to substantially lift the cassette 66 at the time of loading and unloading, and the cassette loading and unloading operations are much easier than in the prior art. In particular, in the electrostatic copying machine of the type shown in FIG. 1 in which the opening 68 of the cassette-receiving section 64 is disposed below the receiving tray 38, the space above the load opening 68 is covered with the receiving tray 38, and it is not easy to lift the cassette and introduce it into the cassette-receiving section 64 through the opening 68 and the loading operation is troublesome in the prior art. However, by constructing the paper feeding device as described above in accordance with the first embodiment of the invention it is no longer necessary to substantially lift the cassette 66 and its loading operation becomes very easy.

It will be easily understood from FIG. 1 that the cassette 66 may be lifted as in the prior art and loaded into the cassette-receiving section 64 directly through the opening 68 without placing it on the surface 104 of the table for example. In this alternative, the inclined portion 98 provided in the cassette 66 acts effectively, and the inclined guide surface 102 of the inclined portion 98 acts to conduct the cassette 66 toward the opening 68 in the same way as described hereinabove.

Figure 4:
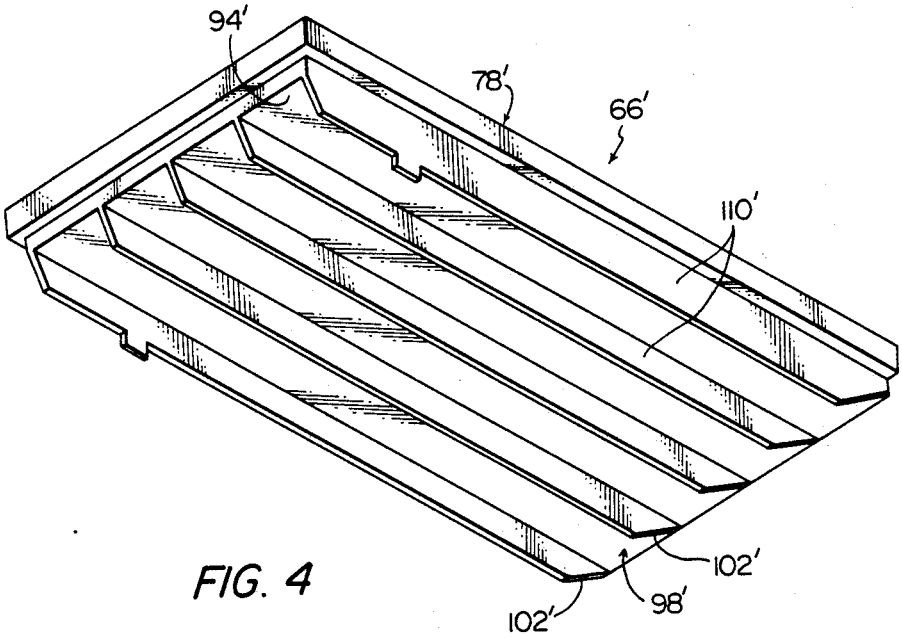
FIG. 4 is a perspective view showing a modified example of the cassette.

FIG. 4 shows a modified example of a cassette to be loaded into the cassette-receiving section. In FIGS. 1 to 3, the bottom wall 94 of the cassette 66 is relatively thick, and the inclined portion 98 is provided in the connecting portion between the bottom wall 94 and the front wall 100. In the modified example, ridge-like members are provided at the bottom wall of the cassette, and an inclined portion is provided in each of the ridge-like members.

In FIG. 4, the cassette 66' of the modified example is provided with a box-like cassette body 78' with an open top surface, and a plurality of (five) ridge-like members 110' spaced from each other in the widthwise direction (the direction substantially perpendicular to the loading direction) are provided as a one-piece unit with the bottom wall 94' of the cassette body 78'. The ridge-like members 110' extend substantially parallel to each other in the front-rear direction, and an inclined portion 98' is provided in the lower part of the front end portion of each ridge-like member 110'. The inclined portion 98' is constructed of an inclined guide edge or surface 102' defined in each ridge-like member 110'. The inclined guide surfaces 102' extend upwardly in a straight line toward the front end of the cassette 66'.

The cassette 66' in the modified example may be used in place of the cassette 66 shown in FIGS. 1 to 3 and achieves the same result as described above. In addition, the bottom wall 94' of the cassette 78' can be made relatively thin, and yet sufficient strength can be obtained by the plurality of the ridge-like members.

Second Embodiment of the Paper Feeding Device

With reference to FIGS. 5 and 6, a second embodiment of the paper feeding device in accordance with this invention will be described. In the second embodiment, the inclined portion for conducting the cassette to the cassette-loading opening is provided in the housing of the copying machine.

In FIGS. 5 and 6 which show the cassette-loading opening provided in the electrostatic copying machine and its vicinity, a rectangular opening 204 is provided at the bottom portion of the left side in FIGS. 5 and 6 of the housing 202, and a cassette-receiving section 206 extends substantially horizontally to the right from the opening 204. One end of a bottom wall 208 of the housing 202 defining the bottom surface of the cassette-receiving section 206 (which one end defines the lower edge of the load opening 204) defines an inclined fixing surface 210 inclined downwardly in the outward direction. A pair of receiving portions 212 and 214 (FIG. 6) are provided at opposite end portions of the inclined fixing surface 210. The receiving portions 212 and 214 are formed by substantially rectangular receiving depressions or depressed portions 216 and 218, and projecting pieces 220 and 222 closing part of the openings to such depressions are provided integrally in the lower corner portions of the respective receiving depressions 216 and 218. In the housing 202, a pair of recesses or depressed portions 226 (only one of which is shown in FIG. 6) for releasably receiving a pair of locking protrusions (not shown) provided in a cassette 224 (FIG. 5) are provided on the upper surface of the bottom wall 208. Furthermore, a pair of receiving portions 230 (FIG. 6) for releasably receiving loading protrusions (not shown) formed in the receiving tray are provided at one end of a partitioning wall 228 defining the upper surface of the cassette-receiving section 206 (which one end defines the upper edge of the load opening 204).

An inclined member shown at 232 of the second embodiment is made up of a nearly L-shaped guiding member 234. The illustrated guiding member 234 has a guiding portion 238 defining an inclined guiding surface 236 and an abutting portion 240 extending substantially horizontally from the lower end of the guiding portion 238. Fixing projecting portions 242 and 244 corresponding to the pair of receiving portions 212 and 214 defined in the housing 202 are provided at opposite end portions of the guiding portion 238, and engaging guide portions 246 and 248 are formed in the fixing projecting portions 242 and 244. Accordingly, by positioning the guiding member 234 at an uppermost position shown by two-dot chain lines in FIG. 5, the engaging guide portions 246 and 248 of the fixing projecting portions 242 and 244 can be mounted on, and detached from, the receiving portions 212 and 214 defined in the housing 202. In the mounted state shown in FIG. 5, the guiding member 234 is free to move between the uppermost position shown by the two-dot chain lines (at which the fixing projecting portions 242 and 244 abut with a upper ends of the receiving portions 212 and 214) and the lowermost position shown by a solid lines (at which the fixing projecting portions 242 and 244 abut with the lower ends of the receiving portions 212 and 214) in an oblique direction shown by an arrow 250 (FIG. 5) along the inner surfaces of the projecting pieces 220 and 222.

In the electrostatic copying machine to which the second embodiment of the paper feeding device is applied, leg portions 252 (only one of which is shown in FIG. 5) provided in the four corner portions of the bottom surface of the housing 202 are adjustable in height. The height of each of the leg portions 252 can be freely adjusted by, for example, screwing an external thread portion formed in its axial portion 254 into the bottom wall 208 of the housing 202.

Because of the above-described structure, it will be easily seen from FIG. 5 that the guide member 234 is held at a predetermined position when the under surface of the abutting portion 240 abuts with the surface 256 of the table on which the housing 202 is placed, and that when the opening 204 is slightly displaced upwardly or downwardly by adjusting the height of the leg portions, the guide member 234 correspondingly moves slightly downwardly or upwardly with respect to the bottom wall 208. The inclined guiding surface 236 of the guiding member 234 extends in an upwardly inclined direction in a straight line from its one end contacting the surface 256 to its other end, and acts to guide the cassette 224 toward the opening 204.

When opening 204 is most elevated by increasing the height of the leg portions 252, the guiding member 234 is held at the lowermost position mentioned above, and when the opening 204 is lowered most by decreasing the height of the leg portions 252, the guiding member is held at a position slightly below the aforesaid uppermost position. Hence, the inclined guiding surface 236 extends in a upwardly inclined direction from its one end contacting the surface 256, and the cassette 224 is accurately guided along the inclined guiding surface 236.

The loading operation of the cassette 224 will now be described with reference mainly to FIG. 5. In this case, too, the cassette 224 is placed on the surface 256 of the table on which the housing 202 is placed, and then moved in the loading direction shown by an arrow 258. As a result, the lower end of the front end portion of the cassette 224 abuts with the inclined guiding surface 236 of the guide member 234. As the cassette 224 moves in the direction of arrow 258, it is lifted toward the opening 204 along the inclined guiding surface 236. When the cassette 224 is further moved, it is guided by the inclined guiding surface 236, and its front end portion is received in the cassette-receiving section 206 through the opening 204. Thus, the cassette 224 is loaded detachably into the cassette-receiving section 206. When the guiding member 234 is at the aforesaid uppermost position in the above operation of guiding the cassette 224 to the opening 204, the cassette 224 is guide by the inclined guiding surface 236 and is directly introduced therefrom into the receiving section 206. When the guiding member 234 is at a position lower than the aforesaid uppermost position, the cassette 224 is guided by the inclined guiding surface 236 and further by the inclined fixing surface 210 of the bottom wall 208 and then introduced into the cassette-receiving section 206. Accordingly, the second embodiment of the paper feeding device achieves the same result as the first embodiment.

In the second embodiment, too, it is preferred to provide an inclined surface 260 inclined upwardly with respect to the loading direction shown by arrow 258 at the lower end of the front end portion of the cassette 224 as shown in FIG. 5 in order to guide the cassette 224 more accurately toward the opening 204.

In the second embodiment, the guiding member 234 is mounted so that it is free to side in an oblique direction shown by arrow 250. It may, however, be mounted vertically pivotally. In the latter case, when the load opening 204 is displaced upwardly or downwardly by adjusting the height of the leg portions 252, the guiding member 234 slightly pivots downwardly or upwardly. As a result, the lower end of the guiding member 234 is kept always in contact with the surface 256. Instead of the above structure, the guiding member 234 may be provided integrally with the housing 202 or mounted detachably on the housing 202 by a bolt or the like.

This Embodiment of the Paper Feeding Device

With reference to FIGS. 7 to 11, a third embodiment of the paper feeding device in accordance with this invention will be described.

Figure 7:
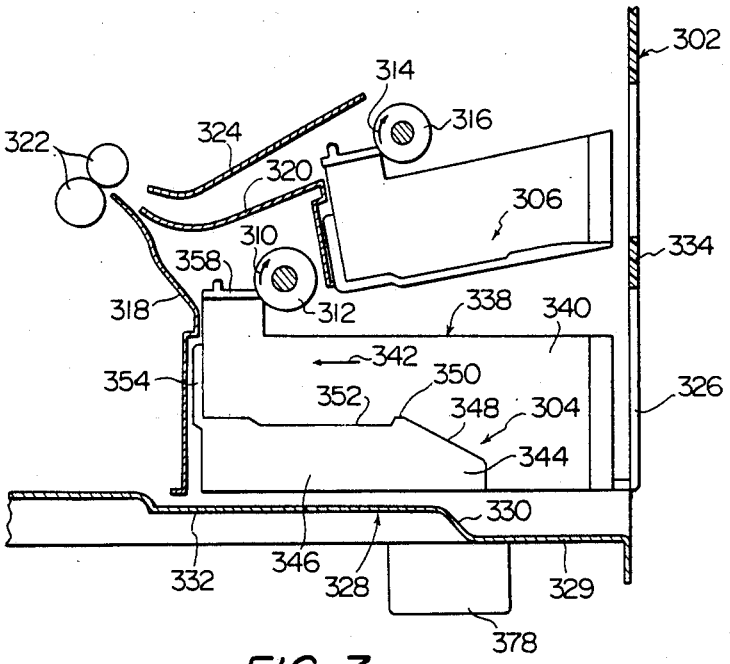
FIG. 7 is a sectional view showing part of an electrostatic copying machine equipped with a third embodiment of the paper feeding device in accordance with this invention.
Figure 8:
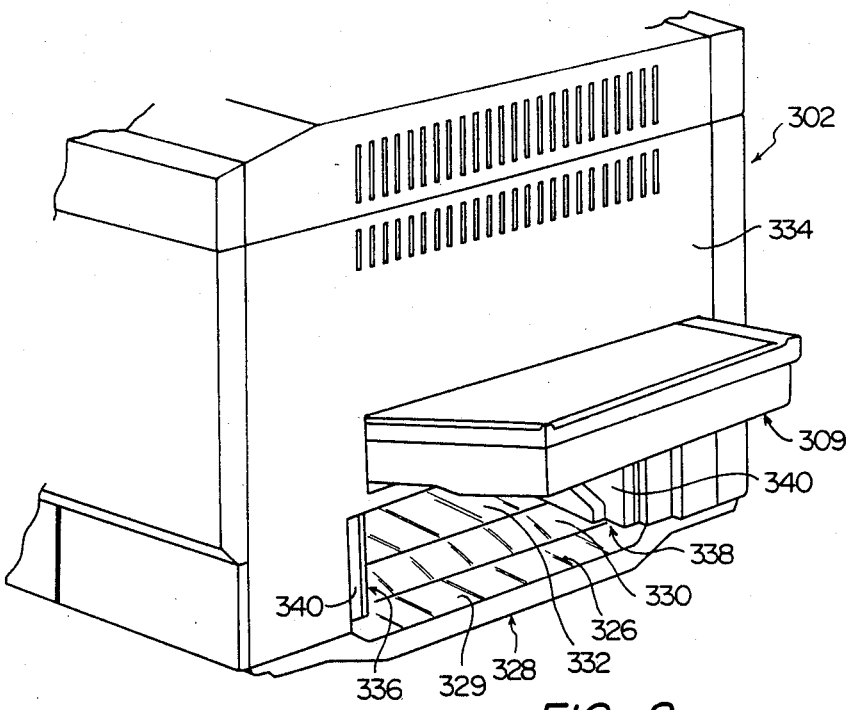
FIG. 8 is a perspective view showing part of the electrostatic copying machine of FIG. 7 in which the cassette has been removed.

In FIGS. 7 and 8, the illustrated electrostatic copying machine is provided with a nearly rectangular parallelpipedal housing 302, and a paper feeding device is provided in the illustrated right lower part of the housing 202.

The illustrated paper feeding device is provided with a lower cassette-receiving section 304 and an upper cassette-receiving section 306 spaced from each other vertically within the housing 302. A cassette 308 shown in FIG. 9 can be detachably loaded into the lower cassette-receiving section 304, and a cassette 309 (FIG. 8) having nearly the same structure as the cassette 308 can be detachably loaded into the upper cassette-receiving section 306. A feed roller 312 adapted to rotate in the direction shown by an arrow 310 is disposed above the lower cassette-receiving section 304, and a feed roller 316 adapted to rotate in the direction shown by an arrow 314 is disposed above the upper cassette-receiving section 306. Accordingly, when the feed roller 312 is rotated, a copying paper sheet is delivered from the cassette 308 loaded in the lower cassette-receiving section 304 and fed into a transfer zone (not shown) through guiding plates 318 and 320 and a pair of conveyor rollers 322. On the other hand, when the feed roller 316 is rotated, a copying paper sheet is delivered from the cassette 309 loaded in the upper cassette-receiving section 306, and fed into the transfer zone (not shown) through guide plates 320 and 324 and the conveyor rollers 322.

In the paper feeding device described above, the present invention is applied to the lower cassette-receiving section 304 and the cassette 308 to be loaded detachably into the cassette-receiving section 304. Accordingly, the lower cassette-receiving section 304 and the cassette 308 will be described below in detail.

Figure 10:
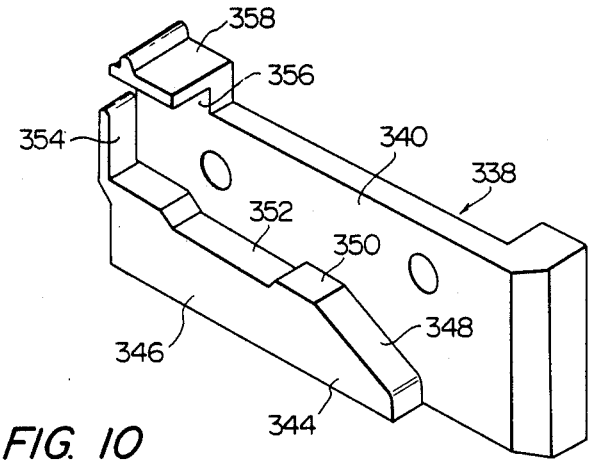
FIG. 10 is a perspective view showing, on an enlarged scale, a cassette-holding member disposed in the cassette-receiving section of the electrostatic copying machine of FIG. 7.

A nearly rectangular cassette-loading opening 326 is defined in the bottom portion of the illustrated right surface or wall of the housing 302. The lower cassette-receiving section 304 extends to the left in FIG. 7 from the opening 326. The lower edge of the opening 326 is defined by one end of the bottom wall 328 of the housing 302, and the bottom wall 328 has a guiding portion 329 extending substantially horizontally from one end of the bottom wall, an inclined portion 330 inclined upwardly to the left in FIG. 7 from the guide portion 329, and a horizontal portion 332 extending substantially horizontally from the inclined portion 330. The upper edge of the opening 326 is defined by a lower edge of right wall 334. A pair of cassette holding members 336 and 338 (FIG. 8) spaced from each other in a direction perpendicular to the sheet surface in FIG. 7 are disposed at opposite side portions of the lower cassette-receiving section 304 (FIG. 7 shows the cassette holding member 338 while FIGS. 11-A to 11-C show the cassette holding member 336). The cassette holding members 336 and 338 are fixed to the inside surfaces of a pair of supporting base plates (not shown) disposed in spaced-apart relationship within the housing 302 by bolts or the like so that they face each other (FIG. 8). Since the cassette holding members 336 and 338 are of substantially the same structure, one cassette holding member 338 will be described. In FIG. 10, the illustrated cassette holding member 338 has a nearly rectangular main body portion 340 fixed to the supporting base plate (not shown). In the lower portion of the inside surface of the main body portion 340 are integrally formed an inclined guiding portion 344 extending in the cassette loading direction shown by an arrow 342 and a guiding portion 346 further extending from the inclined guiding portion 344. The upper end of the inclined guiding portion 344 defines an inclined guiding surface 348 which extends in an upwardly inclined direction in a straight line relative to the loading direction shown by arrow 342. The upper end of the guiding portion 346 defines a horizontal guiding surface 350 which extends substantially horizontally. A locking depressed portion 352 is provided in the upper end part of the guiding portion 346. An upwardly projecting movement hampering piece 354 is formed integrally with the downstream end of the guiding portion 346 as viewed in the loading direction shown by arrow 342. An upwardly extending projecting portion 356 is provided at the downstream end in the aforesaid loading direction of the main body portion 340, and a pivot hampering piece 358 is integrally provided at the upper end of the projecting portion 356.

Figure 9:
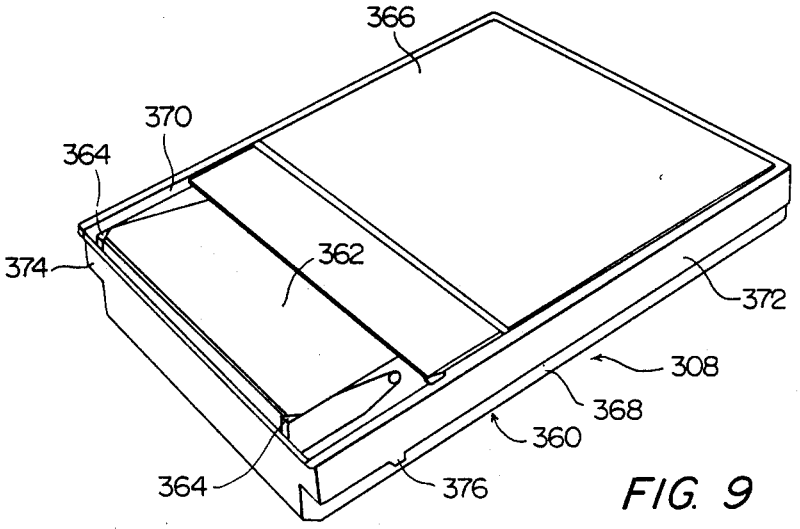
FIG. 9 is a perspective view showing a cassette to be loaded into the cassette-receiving section of the electrostatic copying machine of FIG. 7.

With reference to FIG. 9, the cassette 308 to be loaded detachably between the pair of cassette holding members 336 and 338 is provided with a box-like cassette body 360 having an open top surface. In the cassette body 360, a placing plate 362 is provided vertically pivotally as in the cassette shown in FIG. 2. A pair of claw members 364 are mounted on the two corner portions of the front end of the placing plate 362 so as to be free to pivot slightly in the vertical direction. The rear part of the upper surface of the cassette body 360 is covered with a detachably mounted cover member 366. The upper parts of the outside surfaces of both side walls 368 and 370 of the cassette body 360 are provided with protruding guide portions 372 and 374 corresponding to the inclined guiding portion 344 and the guide portion 346 provided in the pair of cassette holding members 336 and 338. The projecting guide portions 372 and 374 extend from the front end to the rear end of the cassette body 360, and engaging protrusions 376 (only one of which is shown in FIGS. 9 and 11-A) are provided in the front end portions of the protruding guide portions 372 and 374. The engaging protrusions 376 are adapted to be received detachably in the locking depressed portions 352 formed in the cassette holding members 336 and 338.

With reference to FIGS. 11-A to 11-C, the operation of loading and unloading the cassette 308 into and out of the lower cassette-receiving section 304 will be described below.

In loading the cassette 308, the front end portion of the cassette 308 is introduced into the lower cassette-receiving section 304 via the opening 326 formed in the housing 302, and placed on the guiding portion 329 (acting as a first guiding portion in the loading of the cassette 308) of the bottom wall 328 defining the under surface of the lower cassette-receiving section 304 (FIG. 11-A). As a result, the projecting guide portion 372 provided in one side wall 368 of the cassette 308 is positioned inwardly of the main body portion 340 of the cassette holding member 336 (FIG. 11-A) and the projecting guide portion 374 provided in the other side wall 370 of the cassette 308 is positioned inwardly of the main body portion 340 of the cassette holding member 338 (FIG. 7).

Then, the cassette 308 is moved in the loading direction shown by arrow 342. As a result, the lower ends of the front end portions of the projecting guide portions 372 and 374 of the cassette 308 abut with the inclined guiding surfaces 348 of the cassette holding members 336 and 338, and as shown in FIG. 11-B, as the cassette 308 moves in the loading direction of arrow 342, the cassette 308 is lifted upwardly by the action of the inclined guiding surface 348 (whereby the cassette 308 moves away from the guiding portion 329 of the bottom wall 328 to a position thereabove). Further movement of the cassette 308 in the loading direction causes the front ends of the projecting guide portions 372 and 374 to be positioned on the horizontal guiding surfaces 350 of the guiding portions 346 (acting as a second guiding portions in the loading of the cassette 308) beyond the inclined guiding surfaces 348.

The cassette 308 is then moved along the horizontal guiding surfaces 350 in the loading direction to a predetermined position shown in FIG. 11-C. As a result, the front end surfaces of the projecting guide portions 372 and 374 of the cassette 308 abut with the movement hampering pieces 354 of the cassette holding members 336 and 338 to hamper the movement of the cassette 308 beyond a predetermined loaded position. When the cassette 308 has thus been moved to the loaded position, the engaging protrusions 376 provided in the projecting guide portions 372 and 374 are detachably received in the depressed portions 352 formed in the cassette holding members 336 and 338 to thereby releasably lock the cassette 308 into the loaded position releasably. In this loaded state, the projecting guide portions 372 and 374 of the cassette 308 are supported by the horizontal guiding surfaces 350 of the cassette holding members 336 and 338 and the upper surfaces of the front end portions of the two side walls 368 and 370 of the cassette 308 abut with the pivot hampering pieces 358 of the cassette-holding members 336 and 338. Consequently, the cassette 308 loaded into the lower cassette-receiving section 304 is maintained in the state shown in FIG. 11-C. In moving the cassette 308 in the direction of arrow 342, it passes between the main body portions 340 of the cassette holding members 336 and 338 along the inside surfaces thereof.

In order to unload the cassette 308 from the lower cassette-receiving section 304, the cassette 308 is slightly lifted to cancel engagement of the locking engagement protrusions 376 and the depressed portions 352, and then is moved in the unloading direction which is opposite to the direction of arrow 342.

In the third embodiment described hereinabove, the operation of loading the cassette 308 is simple because it is sufficient merely to place the cassette 308 on the guiding portion 329 of the bottom wall 328 through the opening 326 and then move it in the loading direction. Furthermore, it can be appreciated from FIGS. 7 and 8 that owing to the existence of the leg portions 378 provided on the under surface of the bottom wall 328 of the housing 302, the vertical width of the opening 326 of the lower cassette-receiving section 304 can be increased over the prior art by effectively utilizing the space created between the surface of a table (not shown), for example, on which to place the housing 302, and the bottom wall 328. Hence, the front portion of the cassette 308 can be easily introduced into the lower cassette-receiving section 304 through the opening 326. Particularly, in an electrostatic copying machine of the type shown in FIGS. 7 and 8 (in which are provided a plurality of cassette receiving sections 304 and 306 spaced from each other vertically and the cassettes 308 and 309 are detachably loaded into these cassette-receiving sections 304 and 306), the cassette 309 loaded into the upper cassette-receiving section 306 covers the space above the opening 326 of the lower cassette-receiving section 304. In prior arrangements, it is not easy to introduce the cassette 308 into the lower cassette-receiving section 304 through the opening 326. By employing the structure described hereinabove, the vertical width of the opening 326 for loading can be increased over the prior art, and the cassette 308 can be easily loaded into the lower cassette-receiving section 304 in spite of the fact that the space above the opening 326 is covered with the cassette 309 loaded into the upper cassette-receiving section 306.

It will be easily understood from FIG. 7 that the cassette 308 can be directly loaded between the cassette holding members 336 and 338 without first placing it on the guiding portion 329 of the bottom wall 328. In this case, too, the inclined guiding surfaces 348 provided in the cassette holding members 336 and 338 act to conduct the projecting guide portions 372 and 374 of the cassette 308 to the horizontal guiding surface 350.

Fourth Embodiment of the Paper Feeding Device

Now, with reference to FIGS. 12 and 13, a fourth embodiment of the paper feeding device in accordance with this invention will be described.

Figure 12:
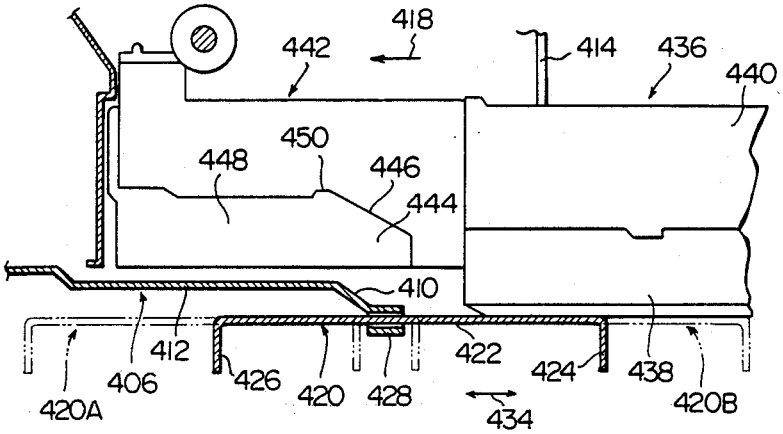
FIG. 12 is a sectional view showing part of an electrostatic copying machine equipped with a fourth embodiment of the paper feeding device in accordance with this invention.
Figure 13:
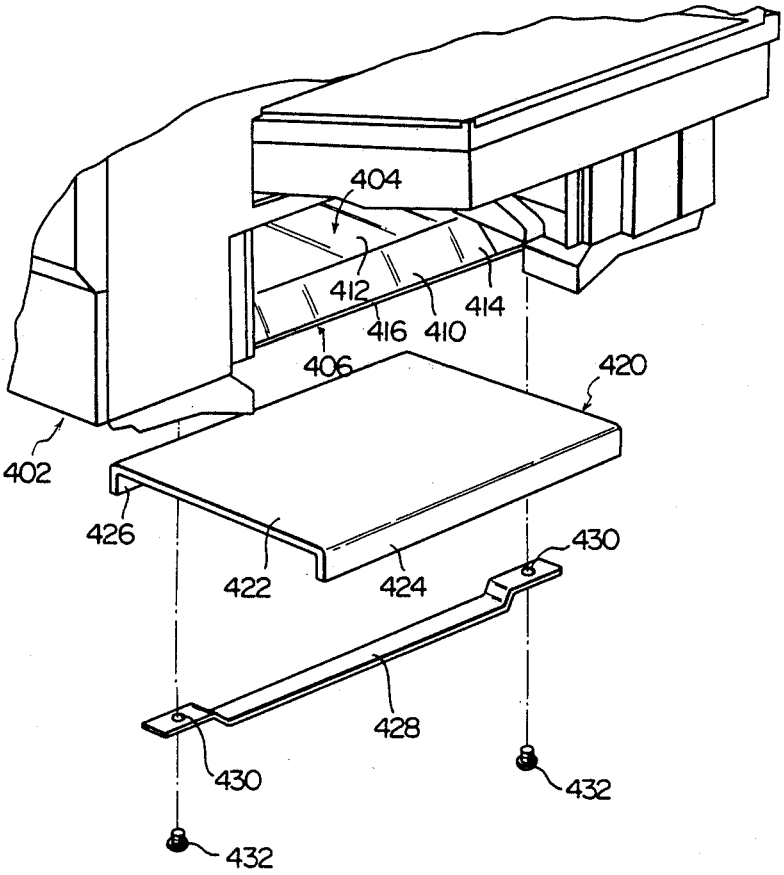
FIG. 13 is a partial exploded perspective view showing part of the electrostatic copying machine of FIG. 12.

In FIGS. 12 and 13 showing part of an electrostatic copying machine provided with a fourth embodiment of the paper feeding device, a bottom wall 406 of a housing 402 of the copying machine, which defines the bottom surface of a lower cassette-receiving section 404 has an inclined portion 410 disposed inwardly of an opening 414 for loading and a horizontal portion 412. In the right end portion in FIGS. 12 and 13 of the bottom wall 406 is formed a rectangular notch 416 over substantially the entire width of the opening 414 in its longitudinal direction. The inclined portion 410 extends in an upwardly inclined manner in the cassette loading direction shown by an arrow 418 from the inside of the opening 414, and the horizontal portion 412 extends substantially horizontally from the upper end of the inclined portion 410.

In the fourth embodiment, a supporting plate 420 defining the lower edge of the opening 414 is provided below the notch 416 formed in the bottom wall 406. More specifically, the supporting plate 420 is provided with a rectangular supporting body 422, and downwardly bent portions 424 and 426 are provided at the forward and rearward ends of the supporting body 422. For mounting the supporting plate 420, there is employed a fixing member 428 which has holes 430 formed at opposite end portions and a depressed portion in an intermediate part. The supporting plate 420 is mounted movably in the direction shown by an arrow 434 on the bottom wall 406 by positioning the supporting body 422 in the depressed portion of the fixing member 428 and then screwing the fixing member 428 into the lower surface of the bottom wall 406 by means of screws 432. Hence, as shown in FIG. 12, the supporting plate 420 is free to move between a maximum storage position shown by two-dot chain lines 420A (at which one bent portion 424 of the supporting plate 420 abuts with the fixing member 428) and a maximum withdrawn position shown by two-dot chain lines 420B (at which the other bent portion 426 of the supporting plate 420 abuts with the fixing member 428), and can be held at one of these positions.

Otherwise, the structure of the fourth embodiment may be substantially the same as that of the third embodiment shown in FIGS. 7 to 11.

The operation of loading a cassette 436 in the fourth embodiment will now be described.

First, the cassette 436 is placed on the supporting main body 422 of the supporting plate 420 (which acts as a first guide portion) through the opening 414 formed in the housing 402. The supporting plate 420 can be held at the above maximum storage position at the time of, for example, carrying the electrostatic copying machine. At the time of installing the electrostatic copying machine or of loading the cassette 436, plate 420 can be withdrawn outside and held at a desired position shown by solid line in FIG. 12. As can be seen from FIG. 12, when the supporting plate 420 is withdrawn to a relatively large extent toward the maximum withdrawn position, it projects outwardly through the opening 414. Hence, the cassette 436 can be easily placed on the supporting plate 420.

Then, the cassette 436 is moved in the direction shown by arrow 418. As a result, substantially as in the third embodiment, projecting guide portions 440 provided in both side walls 438 of the cassette 436 are guided by inclined guiding portions 444 (defining inclined guiding surfaces 446) of the cassette holding members 442 and guiding portions 448 (defining horizontal guiding surfaces 450 and acting as a second guiding portion) and are detachably supported between the cassette holding members 442 (FIG. 12 shows only one each of these members).

The fourth embodiment described above can achieve substantially the same result as in the third embodiment. In addition, since the supporting plate 420 is free to move in the direction shown by arrow 434, loading of the cassette becomes easier by withdrawing the supporting plate 420.

Fifth Embodiment of the Paper Feeding Device

Figure 14:
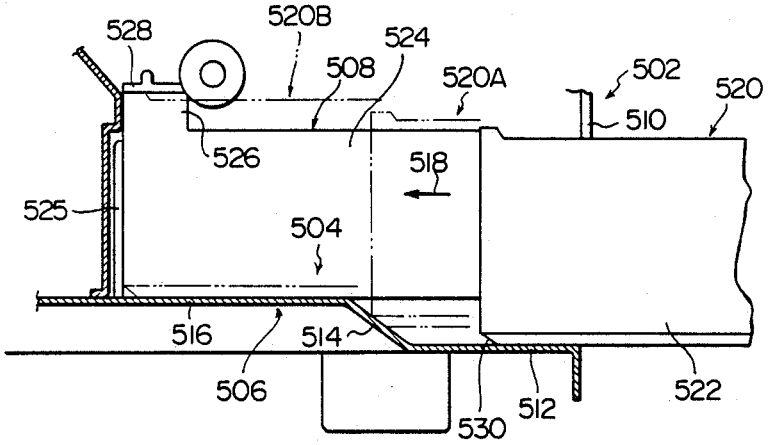
FIG. 14 is a sectional view showing part of an electrostatic copying machine equipped with a fifth embodiment of the paper feeding device in accordance with this invention.

FIG. 14 shows a fifth embodiment of the paper feeding device in accordance with this invention.

In FIG. 14 showing part of an electrostatic copying machine, a cassette-receiving section 504 defined within the housing 502 of the machine is defined by a bottom wall 506 of the housing 502 and side regulating members 508 (only one of which is shown in FIG. 14) mounted on the inside surfaces of a pair of supporting base plates (not shown) fixed to the bottom wall 506 in spaced-apart relationship, and extends to the left from a cassette-loading opening 510 formed in the illustrated right wall of the housing 502. The bottom wall 506 is provided with a first guiding portion 512 extending substantially horizontally from its one end defining the lower edge of the opening 510, an inclined guiding portion 514 extending in an upwardly inclined manner in a straight line in the cassette loading direction shown by an arrow 518 from the first guiding portion 512, and a second guiding portion 516 extending substantially horizontally from the inclined guide portion 514. Each side regulating members 508 guiding opposite side walls 522 of a cassette 520 is provided with respective rectangular guiding portion 524. At one end of the guiding portion 524 are provided an inwardly projecting movement hampering piece 525 and an upwardly extending projecting portion 526. A pivot hampering piece 528 capable of acting on the upper end of a corner portion of the front end of the cassette 520 is provided on the upper end of the projecting portion 526.

Otherwise, the structure of the fifth embodiment may be substantially the same as that of the third embodiment shown in FIGS. 7 to 11.

To load the cassette 520 in the fifth embodiment, the cassette 520 is first placed on the first guiding portion 512 of the bottom wall 506 through the opening 510 as shown by solid lines. Since the first guiding portion 512 is positioned below the second guiding portion 516 and the vertical width of the opening 510 is relatively large, the aforesaid positioning of the cassette 520 can be effected easily.

Then, the cassette 520 is moved in the loading direction shown by arrow 518 along the first guide portion 512. As a result, the lower end of the front end portion of the cassette 520 abuts with the inclined guiding portion 514, and as shown by two-dot chain lines 520A, the cassette 520 is lifted by the action of the inclined guiding portion 514 as the cassette 520 moves in the loading direction (whereby the cassette 520 moves away from the first guiding portion 512 and is positioned thereabove). When the cassette 520 is further moved in the loading direction, the lower end of the front end portion of the cassette 520 is positioned on the second guide portion 516 beyond the inclined guiding portion 514.

Thereafter, the cassette 520 is moved to a predetermined position shown by two-dot chain lines 520B along the second guiding portion 516. As a result, the front end of the cassette 520 abuts with the movement hampering pieces 525 provided in the pair of side regulating members 508 to hamper movement of the cassette 520 beyond the predetermined position. Furthermore, when the cassette 520 has moved to the predetermined position, the pivot hampering pieces 528 provided in the pair of side regulating members 508 act on the upper surfaces of the front end portions of the two side walls 522, thereby hampering pivotal clockwise movement (relative to FIG. 14) of the cassette 520 loaded in the cassette-receiving section 504.

Thus, the fifth embodiment achieves the same result as the third embodiment.

In order to more smoothly move the cassette 520 for loading, it is preferred to provide an inclined surface 530, corresponding to the inclined guiding portion 514 in the cassette-receiving section 504, at the lower end of the front end portion of the cassette 520.

As in the fourth embodiment shown in FIGS. 12 and 13, it is possible to omit the first guiding portion 512 in the bottom wall 506 and to mount a supporting plate acting as the first guiding portion on the under surface of the bottom wall 506 so that it is free to move between a storage position and a withdrawn position.

Modified Examples

The third to fifth embodiments described hereinabove may be applied to electrostatic copying machines of the type shown in FIGS. 1 to 6 (in which a cassette-loading opening is disposed below the receiving tray and a cassette is loaded detachably into this opening). Alternatively, the first and second embodiments described may be applied to electrostatic copying machines of the type shown in FIGS. 7 to 14 (in which a plurality of vertically spaced cassette-receiving sections are disposed and cassettes are loaded detachably into these receiving portions), especially to the lowermost cassette-receiving section.

Furthermore, the third to fifth embodiments may be applied equally to a machine in which three or more cassette-receiving sections are disposed in the vertical direction, and in such arrangement, the paper feeding device of this invention may be applied in relation to not only the lowermost cassette-receiving section but also to other desired cassette-receiving sections.

What we claim is:

1. In a paper feeding device for use in a machine including a housing to be supported on a support surface, said paper feeding device including a cassette-receiving section formed in a portion of said housing, a cassette-loading opening formed in said housing and leading to said cassette-receiving section, and a cassette detachably loadable into said cassette-receiving section through said cassette-loading opening in a loading direction, the improvement comprising means for, upon placing said cassette on the support surface and mounting said cassette in said loading direction, automatically ensuring that a leading end of said cassette, with respect to said loading direction, is conducted to and through said cassette-loading opening into said cassette-receiving section, said means comprising:

an inclined portion formed on said leading end of said cassette, said inclined portion extending in an upwardly and forwardly inclined manner relative to said loading direction, and the vertical dimension between the lower end of said inclined portion and the upper end thereof being greater than the vertical dimension between the support surface and the lower edge of said cassette-loading opening.

2. The improvement claimed in claim 1, wherein said inclined portion comprises an inclined surface formed on said leading end of said cassette and extending across substantially the entire width thereof.

3. The improvement claimed in claim 1, wherein said cassette has extending downwardly from the bottom thereof a plurality ridge-like members extending parallel to said loading direction, and said inclined portion comprises inclined forward edges of said members.

4. In a paper feeding device for use in a machine including a housing to be supported on a support surface, said paper feeding device including a cassette-receiving section formed in a portion of said housing, a cassette-loading opening formed in said housing and leading to said cassette-receiving section, and a cassette detachably loadable into said cassette-receiving section through said cassette-loading opening in a loading direction, the improvement comprising means for, upon placing said cassette on the support surface and moving said cassette in said loading direction, automatically ensuring that a leading end of said cassette, with respect to said loading direction, is conducted to and through said cassette-loading opening into said cassette-receiving section, said means comprising:

an inclined portion formed on at least one of said cassette, said housing and said cassette-receiving section, said inclined portion extending in an upwardly and forwardly inclined manner relative to said loading direction, said inclined portion being positioned below the lower edge of said cassette-loading opening and extending upwardly from a position level with the support surface.

5. The improvement claimed in claim 4, wherein said inclined portion is formed on said housing.

6. In a paper feeding device for use in a machine including a housing to be supported on a support surface, said paper feeding device including a cassette-receiving section formed in a portion of said housing, a cassette-loading opening formed in said housing and leading to said cassette-receiving section, and a cassette detachably loadable into said cassette-receiving section through said cassette-loading opening in a loading direction, the improvement comprising means for, upon placing said cassette on the support surface and moving said cassette in said loading direction, automatically ensuring that a leading end of said cassette, with respect to said loading direction, is conducted to and through said cassette-loading opening into said cassette-receiving section, said means comprising:

an inclined portion formed on a guiding member movably mounted on said housing and having a guiding surface extending in an upwardly and forwardly inclined manner relative to said loading direction from a position below the lower edge of said cassette-loading opening.

7. The improvement claimed in claim 6, wherein said guiding member is movable relative to said housing in a direction parallel to said guiding surface.

* * * * *

UNITED STATES PATENT AND TRADEMARK OFFICE

CERTIFICATE OF CORRECTION

PATENT NO. : 4,915,370

DATED : April 10, 1990

INVENTOR(S) : Tooru HIMEGI

It is certified that error appears in the above-identified patent and that said Letters Patent is hereby corrected as shown below:

On the cover page, rewrite section "[75]" to read --[75] Inventor: Tooru Himegi, Sakai, Japan--.

Item [19] should read --Himegi--

Column 15, line 43, delete "mount-";

line 44, change "ing" to --moving--.

Signed and Sealed this

Fourteenth Day of January, 1992

*Attest:*

HARRY F. MANBECK, JR.

*Attesting Officer*

*Commissioner of Patents and Trademarks*